US007016639B2

(12) United States Patent
Park et al.

(10) Patent No.: US 7,016,639 B2
(45) Date of Patent: Mar. 21, 2006

(54) APPARATUS TO COLLECT USED TONER IN A LASER PRINTER

(75) Inventors: Ki-ju Park, Yongin (KR); Hyo-jin Lee, Suwon (KR); Ii-kwon Kang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 64 days.

(21) Appl. No.: 10/765,915

(22) Filed: Jan. 29, 2004

(65) Prior Publication Data

US 2004/0258441 A1 Dec. 23, 2004

(30) Foreign Application Priority Data

Jun. 18, 2003 (KR) ..... 10-2003-0039577

(51) Int. Cl.
*G03G 21/00* (2006.01)

(52) U.S. Cl. ..... 399/350; 399/99; 399/351

(58) Field of Classification Search ..... 399/123, 399/350, 351, 358, 360, 101, 99
See application file for complete search history.

(56) References Cited

U.S. PATENT DOCUMENTS 6,298,217 B1 * 10/2001 Murayama et al. ..... 399/358

FOREIGN PATENT DOCUMENTS

JP 10-020730 1/1998

OTHER PUBLICATIONS

The Official Action issued by the Korean Intellectual Property Office on Feb. 25, 2005, and listing 1 reference.

* cited by examiner

*Primary Examiner*—Hoang Ngo
(74) *Attorney, Agent, or Firm*—Stanzione & Kim, LLP

(57) ABSTRACT

An apparatus to collect a used toner on a photoconductive drum in a laser printer, includes: a used toner collecting bucket having a used toner entry port into which the used toner on the photoconductive drum flows; a cleaning blade installed at the used toner entry port to guide the used toner to the used toner entry port by scraping off the used toner from the photoconductive drum; and a used toner transferring unit to transfer the used toner so that the used toner accumulated at the used toner entry port is evenly distributed within the used toner collecting bucket.

24 Claims, 2 Drawing Sheets

APPARATUS TO COLLECT USED TONER IN A LASER PRINTER

CROSS-REFERENCE TO RELATED APPLICATIONS

This application claims the benefit of Korean Patent Application No. 2003-39577 filed Jun. 18, 2003, in the Korean Intellectual Property Office, the disclosure of which is incorporated herein by reference.

BACKGROUND OF THE INVENTION

1. Field of the Invention

The present invention relates to an apparatus for collecting a used toner in a laser printer.

2. Description of the Related Art

Generally, an electrophotographic printer has: a photoconductive medium such as a photoconductive drum; a charging apparatus to charge a surface of the photoconductive drum to an electric potential of a predetermined level; an LSU(Laser Scanning Unit) to scan a laser beam on the charged surface of the photoconductive drum; a developing unit to perform developing by supplying a toner to an electrostatic latent image region formed on the photoconductive drum by the scanned laser beam; a transferring unit to transfer the toner developed on the photoconductive drum to a printing paper; and a used toner collecting apparatus to collect the used toner by cleaning the used toner remaining on the surface of the photoconductive drum.

In the above construction, the used toner collecting apparatus has: a cleaning blade in contact with the photoconductive drum to scrape off the used toner on the photoconductive drum; and a used toner collecting bucket to accommodate the used toner collected by the cleaning blade. At a toner entry port of the used toner collecting bucket, the cleaning blade is installed. The used toner collected by the cleaning blade is accumulated at the toner entry port of the toner collecting bucket and gradually pushed into the inside of the toner collecting bucket. If the toner collecting bucket is filled with the used toner collected in this way, the toner collecting bucket is thrown away and replaced by a new one.

But, according to the above construction, the used toner may be excessively accumulated between the cleaning blade and the toner entry port of the toner collecting bucket. In this case, the function of the cleaning blade deteriorates due to the excessively accumulated used toner, and further the used toner is not efficiently transferred into the inside of the toner collecting bucket. Also, the toner entry port of the toner collecting bucket is blocked before the used toner is evenly filled up within the toner collecting bucket.

SUMMARY OF THE INVENTION

Accordingly, the present invention has been made to solve the above and/or other problems occurring in the prior art, and it is an aspect of the present invention to provide an apparatus to collect a used toner in a laser printer, having an improved structure, capable of forcibly transferring the used toner accumulated at a toner entry port of the toner collecting bucket into the inside of the toner collecting bucket.

Additional aspects and advantages of the invention will be set forth in part in the description which follows and, in part, will be obvious from the description, or may be learned by practice of the invention.

The foregoing and/or other aspects of the present invention are achieved by providing an apparatus to collect a used toner on a photoconductive drum in a laser printer, the apparatus comprising: a used toner collecting bucket having a used toner entry port into which the used toner on the photoconductive drum flows; a cleaning blade installed at the used toner entry port to guide the used toner through the used toner entry port by scraping the used toner off the photoconductive drum; and a used toner transferring unit to transfer the used toner scraped off the photoconductive drum so that the used toner accumulated at the used toner entry port is evenly accumulated within the used toner collecting bucket.

Here, the used toner transferring unit includes: an eccentric shaft to perform an eccentric motion with respect to a driving axis installed, in a rotatable manner, on the used toner collecting bucket; and a paddle member cooperating with the eccentric shaft to move the used toner at the used toner entry port step by step into the used toner collecting bucket while reciprocating along a predetermined trajectory.

Further, the paddle member includes: an axle supporting part having a cam groove in which a crankshaft is connected in a rotatable manner; a paddle front end connected to one end of the axle supporting part to scrape a toner at the used toner entry port down to a bottom of the inside of the collecting bucket while repeating a predetermined trajectory motion and cooperating with a motion of the axle supporting part due to the crankshaft; and a paddle rear end connected to an opposite side of the axle supporting part with respect to the paddle front end to scrape the used toner, moved to the bottom of the used toner collecting bucket by the paddle front end, step by step into the toner collecting bucket while repeating a predetermined trajectory motion.

It is another aspect of the invention that the paddle front end extends by a predetermined length in a predetermined direction from the axle supporting part so that it is spaced apart from the bottom of the used toner collecting bucket, and has, at its front end, a curve-shaped hook portion to scrape off the used toner accumulated at the used toner entry port.

In another aspect of the invention, the paddle rear end is formed of a plate shape so that it gradually pushes the used toner on the bottom into the inside of the used toner collecting bucket while sliding across the bottom thereof, in contact with the bottom inner side of the used toner collecting bucket for an interval during its trajectory motion.

Also, in this case, a plurality of slots are formed, at predetermined intervals, on the paddle rear end so that the used toner on the bottom of the used toner collecting bucket can be moved step by step.

Further, the slots are formed at a predetermined length and in a direction substantially perpendicular to a direction of the trajectory motion of the paddle rear end.

In another aspect of the invention, a movement trajectory of the paddle member comprises: a transferring trajectory that moves the used toner located at the used toner entry port into the used toner collecting bucket while moving from the used toner entry port towards the inner direction; and a returning trajectory that returns to a direction toward the used toner entry port from the inside of the used toner collecting bucket after the transferring trajectory movement.

Also, in this case, the transferring trajectory of the paddle member proceeds while the eccentric axle passes by the lowest point with respect to the driving axis, and the returning trajectory proceeds while the eccentric axle passes by the highest point with respect to the driving axis.

In another aspect of the invention, the transferring trajectory comprises a straight line so that the paddle member can slide across the bottom inner side of the used toner collecting bucket.

In another aspect of the invention, the returning trajectory forms a circular arc of a predetermined shape so that movement is made with part of the paddle member spaced apart from the bottom of the used toner collecting bucket.

In yet another aspect of the invention, the paddle member is installed between the paddle front end and the paddle rear end, and further comprises a sheet-type paddle part to move the used toner, transferred into the used toner collecting bucket by the paddle front end, into a trajectory range of the paddle rear end.

In yet another aspect of the invention, the cam groove of the axle supporting part is formed vertically at a predetermined length so that it is closed in an upper direction and opened in a lower direction, and the eccentric axle raises up the axle supporting part when passing by the highest point and moves the axle supporting part horizontally when passing by the lowest point.

Here, the paddle member is installed so that its center of mass is biased toward the paddle rear end with respect to the eccentric axle.

In still another aspect of the invention, the used toner entry port is positioned on an upper part of the used toner collecting bucket at a predetermined height from the bottom thereof, and the paddle member comprises: an axle supporting part having a cam groove with which the eccentric axle is connected in a rotatable manner, and reciprocating along a predetermined trajectory by the eccentric axle; a paddle front end extending to one side from the axle supporting part, to drop the used toner at the used toner entry port down to the bottom of the inner side of the used toner collecting bucket; a sheet-type paddle installed between the paddle front end and the axle supporting part to move by a predetermined distance, the used toner dropped down on the bottom of the used toner collecting bucket; and a paddle rear end extending to the other side of the axle supporting part to transfer the used toner, delivered by the sheet-type paddle, step by step into the used toner collecting bucket.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
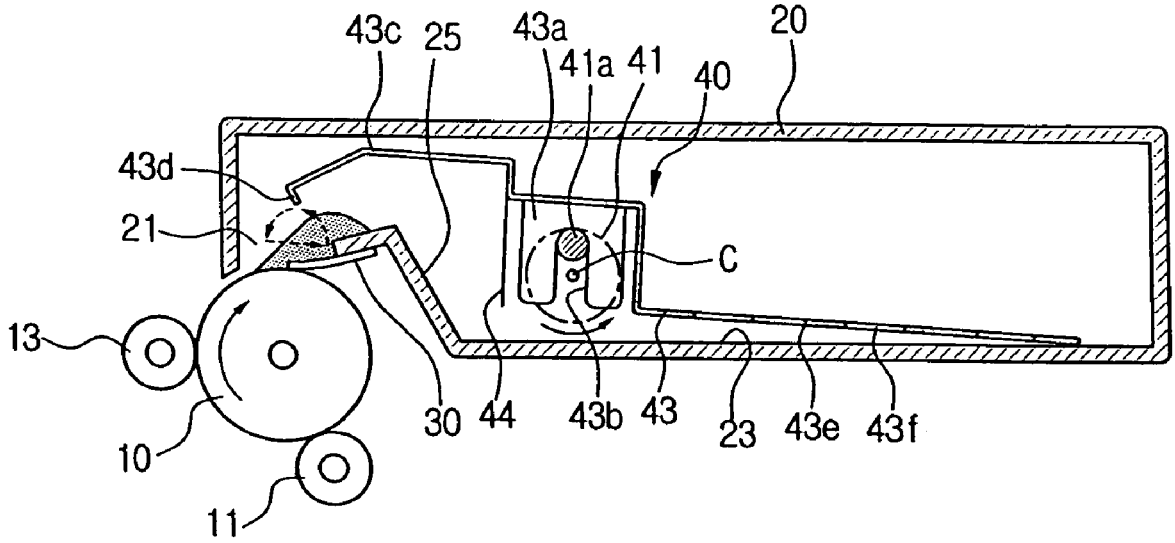
FIG. 1 is a cross-sectional view schematically illustrating an apparatus to collect a used toner in a laser printer according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Referring to FIG. 1, an apparatus to collect a used toner in a laser printer according to an embodiment of the present invention collects the used toner by cleaning the used toner remaining on the surface of a photoconductive drum 10, which is a photoconductive medium. Such an apparatus to collect the used toner has: a used toner collecting bucket 20 having a used toner entry port 21; a cleaning blade 30 installed at the used toner entry port 21 to guide the used toner toward the used toner entry port 21 by scraping off the used toner from the surface of the photoconductive drum 10; and a used toner transferring unit 40 to forcibly transfer the used toner accumulated over the range between the used toner entry port 21 and the cleaning blade 30 into the used toner collecting bucket 20.

The photoconductive drum 10 forms an image on its surface in the same manner as the generally known printing method of a laser printer. For example, the photoconductive drum 10 is charged by a charging unit (not shown), then partially exposed to light by a laser scanning unit(LSU), and a toner is delivered to an exposed portion by a developing unit including a developing roller 11 so that a latent image is developed into a visual image. The visual image prepared in this manner is delivered to a transferring medium such as a transferring roller 13. At this point, the used toner that has not yet been transferred remains on the photoconductive drum 10. Such used toner is cleaned off from the photoconductive drum 10 by the cleaning blade 30.

The used toner collecting bucket 20 has, at its one end, a used toner entry port 21 provided at a predetermined height, that faces the photoconductive drum 10, and is of a closed case shape at its other end. Therefore, a bottom 23 inner side of the used toner collecting bucket 20 is provided at a lower position as compared to the entry port 21. An inclined wall 25 is provided between the used toner entry port 21 and the bottom 23.

At the lower side of the used toner entry port 21, the cleaning blade 30 is supported such that the used toner, cleaned by the cleaning blade 30, is dominantly accumulated at a front surface of the cleaning blade 30 and the used toner entry port 21.

The used toner transferring unit 40 transfers the used toner accumulated between the used toner entry port 21 and the cleaning blade 30 so that the used toner can be accumulated into the used toner collecting bucket 20 in a step by step fashion. Such used toner transferring unit 40 has an eccentric axle 41*a* to perform an eccentric motion with respect to a driving axle 41, which is installed, in a rotatable manner, on the used toner collecting bucket 20, and a paddle member 43 to transfer the used toner accumulated at the entry port 21 into the used toner collecting bucket 20 while reciprocating along a predetermined trajectory within the used toner collecting bucket 20 and cooperating with the eccentric axle 41*a*.

Figure 2:
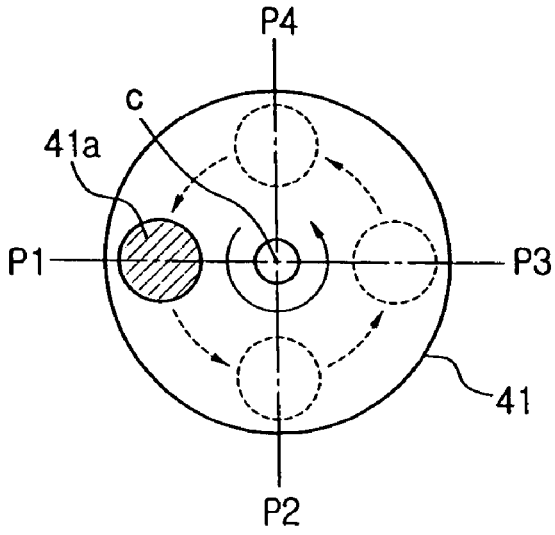
FIG. 2 illustrates an operation of the eccentric axle shown in FIG. 1.

The eccentric axle 41*a*, as shown in FIG. 2, moves around a rotational center "c" of the driving axle 41 along a predetermined circular arc. Therefore, during one time of rotation of the driving axle 41, the eccentric axle 41*a* performs one stroke that sequentially passes by the foremost front point P1, the lowest point P2, the farthest rear point P3 and the highest point P4.

The paddle member 43 has an axle supporting part 43*a* having a cam groove 43*b* to which the eccentric axle 41*a* is placed in a rotatable manner, a paddle front end 43*c* extending at a predetermined shape from one side of the axle supporting part 43*a*, a paddle rear end 43*e* extending toward an opposite side of the axle supporting part 43*a* with respect to the paddle front end 43*b*.

The cam groove 43*b*, formed on the axle supporting part 43*a*, is provided vertically at a predetermined length, and has the structure whose upper end is closed and whose lower end is open. Therefore, if the eccentric axle 41*a* is moved to the highest point P4, the axle supporting part 43*a* is raised up by the eccentric axle 41*a*. In contrast, if moved to the lowest point P2, the eccentric axle 41*a* is simply lowered along the cam groove 43*b*, not lowering down the axle supporting part 43*a*.

The paddle front end 43*c* is integrally formed at one side of the axle supporting part 43*a* and extends therefrom, and scrapes off the used toner at the used toner entry port 21 while repeating a predetermined trajectory motion upon movement of the axle supporting part 43*a*. For this purpose, a hook portion 43*d* that is bent-shaped to scrape off the used toner is provided at the foremost front end of the paddle front end 43*c*.

The paddle rear end 43*e* extends from the axis supporting part 43*a* at an opposite side from the side in which the paddle front end 43*c* extends, and is formed with a plate shape so that it sticks on the bottom 23 of the used toner collecting bucket 20. The paddle rear end 43*e* has a plurality of slots 43*f* formed at predetermined intervals. The slots 43*f* are formed at a predetermined length in a direction perpendicular to the trajectory motion direction of the paddle rear end 43*e*, i.e., the direction perpendicular to the forward-backward direction of the paddle rear end 43*e*. The paddle rear end 43*e*, having such construction, moves the used toner that has fallen to the bottom 23 inside of the used toner collecting bucket 20 in a step by step fashion using the slots 43*f*.

Also, a sheet type paddle 44, to move the used toner that has fallen to the bottom 23 of the used toner collecting bucket 20 from the used toner entry port 21 due to the paddle front end 43*c* into the moving range of the paddle rear end 43*e*, is additionally provided. The sheet type paddle 44 is installed between the paddle front end 43*c* and the axle supporting part 43*a*, and pushes the used toner on the bottom 23 of the used toner collecting bucket toward the paddle rear end 43*e* with its one end contacting the bottom 23 of the used toner collecting bucket 20 for a predetermined interval along the trajectory motion of the axle supporting part 43*a*.

The paddle member 43, having such a construction as described above, is moved along a predetermined trajectory by rotation of the eccentric axle 41*a*. Here, the trajectory movement of the paddle member 43 is divided into a used toner transferring trajectory movement and a used toner returning trajectory movement.

Figure 4:
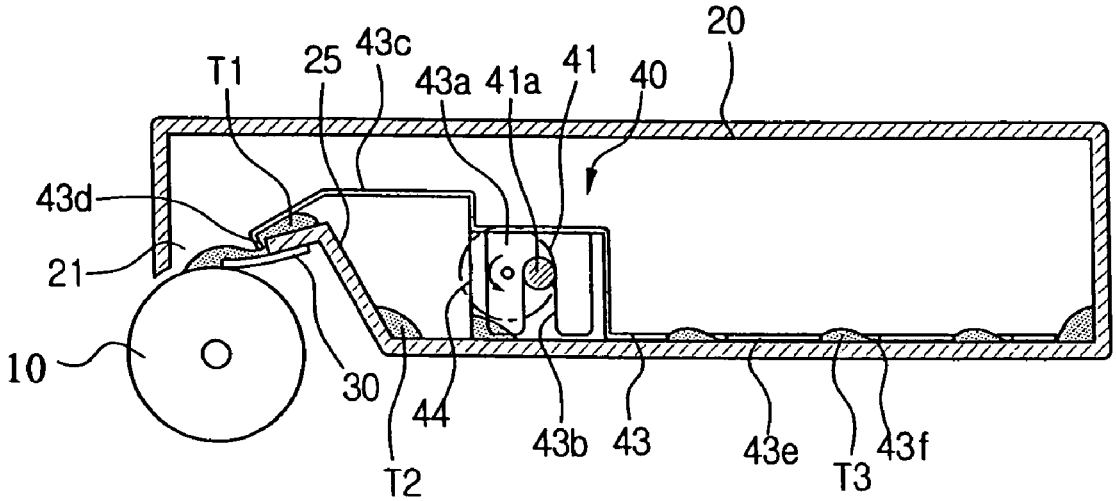

The used toner transferring trajectory movement represents an interval during which the paddle member 43 moves while the eccentric axle 41*a* passes by the lowest point P2 and reaches up to the farthest rear point P3(shown in FIG. 4) from the state of being positioned at the foremost front point P1 (shown in FIG. 2). During this transferring trajectory movement, the paddle front end 43*c* scrapes off the used toner T1 accumulated at the used toner entry port 21 toward the inclined wall 25 so that the used toner falls down to the bottom 23 of the toner collector bucket while moving straight. Then, the sheet type paddle 44 moves the used toner T2 into the used toner collecting bucket 20 so that the used toner T2 is positioned within the moving range of the paddle rear end 43*e* by pushing the used toner T2 that has fallen to the bottom 23 of the used toner collector bucket 20 from the entry side. Also, the paddle rear end 43*e* moves the used toner T3 moved by the sheet type paddle 44 in a step by step fashion into the used toner collecting bucket 20 using the slots 43*f* while performing a straight line motion at the state of being in contact with the bottom 23 of the used toner collecting bucket 20. As described above, the transferring trajectory movement of the paddle member 43 is represented as a straight line, since the lower end of the cam groove 43*b* is open and movement of the eccentric axle 41*a* is freely allowed, as is revealed in the foregoing.

Figure 3:
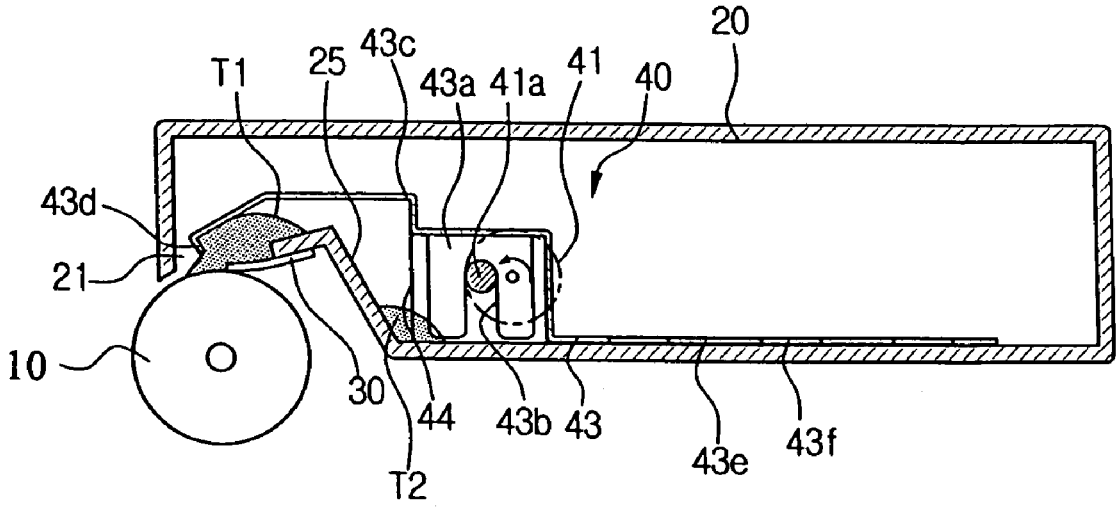
FIG. 3 and FIG. 4 each illustrate operations of transferring the used toner to collect the used toner using the apparatus of FIG. 1.

In the meantime, the returning trajectory movement represents an interval during which the eccentric axle 41*a* starts from the farthest rear point P3 (shown in FIG. 4) and passes by the highest point P4 (shown in FIG. 1), then returns back to the state of FIG. 2. During that returning trajectory movement, the paddle front end 43*c* returns to the position shown in FIG. 3 while representing an elliptical trajectory. Namely, during that returning trajectory movement, the eccentric axle 41*a* moves the axle supporting part 43*a*, raising the same, thus the hook portion 43*d* of the paddle front end 43*c* is separated and moved to the upper part of the used toner entry port 21 and finally moved to the position where the hook portion 43*d* can scrape off the used toner T1 once again.

Also, the end portion of the paddle rear end 43*e* is in contact with the bottom 23 of the used toner collecting bucket 20 and the other portion of the paddle rear end 43*e* is spaced apart from the bottom 23 of the used toner collecting bucket 20, as shown in FIG. 1, when the paddle member 43 returns to its original position, thus the used toner transferred to the inside of the used toner collecting bucket 20 is prevented from being transferred back to the used toner entry port 21 by the paddle rear end 43*e*.

As described above, in order to effectively transfer the used toner while reciprocating along the transferring trajectory and the returning trajectory, the paddle member 43 is installed such that its center of mass is positioned on the paddle rear end 43*e* with the eccentric axle 41*a*being centered. With such construction, the paddle member 43 is always given a gravitational force such that the paddle rear end 43*e* is naturally in contact with the bottom 23 by a seesaw operation, whereby the used toner on the bottom 23 of the used toner collecting bucket 20 is effectively transferred. Also, the paddle front end 23*c* is given a force that will float away from the bottom 23, the used toner entry port 21 and the cleaning blade 30, and thus the used toner only can be smoothly scraped off from the photoconductive drum 10 without interference with the used toner entry port 21 or the cleaning blade 30.

As is apparent from the foregoing, an apparatus to collect the used toner in the laser printer according to the present invention is capable of forcibly transferring the used toner accumulated over the range from the used toner entry port 21 of the used toner collecting bucket 20 to the cleaning blade 30, into the used toner collecting bucket 20 after the used toner is cleaned from the photoconductive drum 10.

Also, the apparatus to collect the used toner in the laser printer according to the present invention is capable of uniformly accommodating the used toner in the used toner collecting bucket 20 by transferring the used toner that enters the used toner collecting bucket 20, in the step by step fashion, into the used toner collecting bucket 20, thus effectively utilizing the space within the used toner collecting bucket 20.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An apparatus to collect a used toner on a photoconductive drum in a laser printer, the apparatus comprising:

a used toner collecting bucket having a used toner entry port into which the used toner on the photoconductive drum flows;

a cleaning blade installed at the used toner entry port to guide the used toner to the used toner entry port by scraping the used toner off from the photoconductive drum; and a used toner transferring unit to transfer the used toner so that the used toner accumulated at the used toner entry port is evenly distributed within the used toner collecting bucket.

2. The apparatus according to claim 1, wherein the used toner transferring unit comprises:

an eccentric axle to perform an eccentric motion with respect to a driving axle installed, in a rotatable manner, within the used toner collecting bucket; and a paddle member cooperating with the eccentric axle to move the used toner at the used toner entry port, step by step, into the used toner collecting bucket while reciprocating along a predetermined trajectory.

3. The apparatus according to claim 2, wherein the paddle member comprises:

an axle supporting part having a cam groove in which a crankshaft is placed in a rotatable manner;

a paddle front end to scrape a toner located at the used toner entry port down to a bottom of the used toner collecting bucket while repeating a predetermined trajectory motion, cooperating with a motion of the axle supporting part due to the crankshaft; and a paddle rear end connected to an opposite side of the paddle front end with respect to the axle supporting part to scrape the used toner moved to the bottom of the used toner collecting bucket by the paddle front end into the used toner collecting bucket while repeating the predetermined trajectory motion.

4. The apparatus according to claim 3, wherein the paddle front end extends by a predetermined length in a predetermined direction from the axle supporting part so that the paddle front end is spaced from the bottom of the used toner collecting bucket, and has in a front end thereof a curve-shaped hook portion to scrape off the used toner accumulated at the used toner entry port.

5. The apparatus according to claim 3, wherein the paddle rear end is formed of a plate shape to gradually push out the used toner on the bottom of the used toner collecting bucket into the used toner collecting bucket while sliding across the bottom thereof while being in contact with the bottom of the used toner collecting bucket for an interval during its trajectory motion.

6. The apparatus according to claim 4, wherein the paddle rear end is formed of a plate shape to gradually push out the used toner on the bottom of the collecting bucket while sliding across the bottom thereof while in contact with the bottom of the used toner collecting bucket for an interval during its trajectory motion.

7. The apparatus according to claim 4, wherein a plurality of slots are formed, at a predetermined interval on the paddle rear end so that the used toner on the bottom of the used toner collecting bucket is moved along at step intervals.

8. The apparatus according to claim 7, wherein the plurality of slots are formed at a predetermined length and in a direction perpendicular to a direction of the trajectory motion of the paddle rear end.

9. The apparatus according to claim 2, wherein a movement trajectory of the paddle member comprises:

a transferring trajectory movement that moves the used toner located at the used toner entry port into the used toner collecting bucket while moving from the used toner entry port to an inner direction of the used toner collecting bucket; and a returning trajectory movement that returns to a direction toward the used toner entry port from the inside of the used toner collecting bucket after the transferring trajectory movement.

10. The apparatus according to claim 9, wherein the transferring trajectory movement of the paddle member is performed while the eccentric axle passes by a lowest point with respect to the driving axle, and the returning trajectory movement is performed while the eccentric axle passes by a highest point with respect to the driving axle.

11. The apparatus according to claim 9, wherein the transferring trajectory movement comprises a straight line so that the paddle member slides across the bottom inner side of the used toner collecting bucket.

12. The apparatus according to claim 10, wherein the transferring trajectory movement comprises a straight line so that the paddle member slides across the bottom inner side of the used toner collecting bucket.

13. The apparatus according to claim 10, wherein the returning trajectory movement forms a circular arc of a predetermined shape so that a movement is made with part of the paddle member spaced apart from the bottom of the used toner collecting bucket.

14. The apparatus according to claim 3, wherein the axle supporting part is installed between the paddle front end and the paddle rear end.

15. The apparatus according to claim 3, wherein the cam groove of the axle supporting part is formed vertically at a predetermined length and is closed in an upper direction and opened in a lower direction, and the eccentric axle raises up the axle supporting part when passing by a highest point and moves the axle supporting part horizontally when passing by a lowest point.

16. The apparatus according to claim 3, wherein the paddle member is installed so that its center of mass is biased to a side of the paddle rear end with respect to the eccentric axle.

17. The apparatus according to claim 2, wherein the used toner entry port is positioned on an upper part of the used toner collecting bucket at a predetermined height from the bottom, and the paddle member comprises:

an axle supporting part having a cam groove in which the eccentric axle is connected in a rotatable manner, and reciprocating along a predetermined trajectory by the eccentric axle;

a paddle front end extending away from one side of the axle supporting part to drop the used toner located at the used toner entry port down to the bottom inner side of the used toner collecting bucket;

a sheet-type paddle installed between the paddle front end and the axle supporting part to move, along a predetermined distance, the used toner dropped down to the bottom inner side of the used toner collecting bucket; and a paddle rear end extending from another side of the axle supporting part, to transfer the used toner, delivered by the sheet-type paddle, step by step along the inside of the used toner collecting bucket.

18. The apparatus according to claim 14, wherein the paddle member further comprises:

a sheet-type paddle part to move the toner transferred into the toner collecting bucket by the paddle front end into a trajectory range of the paddle rear end.

19. A toner removing apparatus to remove toner from a toner image transferring member, the toner removing apparatus comprising:

a toner collecting container having a toner entry port therein to collect the toner from the toner image transferring member;

a cleaning member positioned at the toner entry port to guide the toner from the toner image transferring member through the toner entry port; and a used toner transferring member to transfer the guided toner away from the toner entry port and along a bottom of the toner collecting container to evenly distribute the toner therein.

20. The toner removing apparatus according to claim 19, wherein the toner collecting container further comprises:

an eccentric cam to engage with and move the toner transferring member eccentrically within the toner collecting container such that the toner is guided away from the toner entry port and along the bottom of the toner collecting container at the same time.

21. The toner removing apparatus according to claim 20, wherein the used toner transferring member comprises:

a front end to scrape the guided toner away from the toner entry port and into the toner collecting container;

a rear end to evenly distribute the scraped toner along a bottom of the toner collecting container; and a sheet type paddle member extending from the toner image transferring member to move the scraped toner toward the rear end of the toner image transferring member.

22. The toner removing apparatus according to claim 21, wherein the rear end of the toner transferring member is formed of a plate shape to gradually distribute the used toner on the bottom of the toner collecting container while sliding across the bottom thereof.

23. The toner removing apparatus according to claim 22, wherein the rear end of the toner image transferring member has a plurality of slots formed therein to engage with and distribute the toner within the toner collecting container.

24. A toner storage apparatus to collect used toner, comprising:

a used toner collecting bucket having a used toner entry port into which the used toner flows; and a used toner transferring unit that is disposed in the used toner collecting bucket and is substantially linearly movable along a bottom portion thereof to transfer the used toner such that the used toner that flows into the used toner entry port is evenly distributed within the used toner collecting bucket.

* * * * *